US009477195B2

(12) United States Patent
Totsuka

(10) Patent No.: US 9,477,195 B2
(45) Date of Patent: Oct. 25, 2016

(54) IMAGE FORMING APPARATUS

(71) Applicant: Oki Data Corporation, Tokyo (JP)

(72) Inventor: Toshiyuki Totsuka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/974,599

(22) Filed: Dec. 18, 2015

(65) Prior Publication Data

US 2016/0282785 A1 Sep. 29, 2016

(30) Foreign Application Priority Data

Mar. 24, 2015 (JP) ..... 2015-060616

(51) Int. Cl.
*G03G 15/00* (2006.01)

(52) U.S. Cl.
CPC ..... *G03G 15/6529* (2013.01)

(58) Field of Classification Search
CPC ..... G03G 15/5029
USPC ..... 399/388
See application file for complete search history.

(56) References Cited

U.S. PATENT DOCUMENTS 5,311,267 A * 5/1994 Bean ..... G03G 15/754 399/164
6,449,444 B1 * 9/2002 Tanaka ..... G03G 15/1675 399/313
8,515,311 B2 * 8/2013 Kishi ..... G03G 15/161 399/121
2003/0086733 A1 * 5/2003 Sawai ..... G03G 15/167 399/302
2005/0047840 A1 * 3/2005 Ohashi ..... B41J 13/0063 399/388
2007/0280750 A1 * 12/2007 Kurosu ..... G03G 15/1605 399/316
2008/0019717 A1 * 1/2008 Soshiroda ..... G03G 15/161 399/45
2009/0074435 A1 * 3/2009 Murakami ..... G03G 15/5029 399/45
2011/0188891 A1 * 8/2011 Ryu ..... G03G 15/16 399/121
2015/0050058 A1 * 2/2015 Hunter ..... G03G 15/6558 399/388

FOREIGN PATENT DOCUMENTS

JP 2011-133529 A 7/2011

* cited by examiner

*Primary Examiner* — Anthony Nguyen

(74) *Attorney, Agent, or Firm* — Muncy, Geissler, Olds & Lowe, P.C.

(57) ABSTRACT

An image forming apparatus includes an image carrier that carries a developer image, a carrying part that carries a medium; and a guide part that forms a carrying path to guide the medium carried by the carrying part toward a transfer position where the developer image carried by the image carrier is transferred to the medium. The guide part is configured to change a thickness of the carrying path according to a kind of the medium.

16 Claims, 13 Drawing Sheets

IMAGE FORMING APPARATUS

CROSS REFERENCE

The present application is related to, claims priority from and incorporates by reference Japanese Patent Application No. 2015-060616, filed on Mar. 24, 2015.

TECHNICAL FIELD

The present application relates to an image forming apparatus that forms an image on a medium.

BACKGROUND

In general, in an image forming apparatus that adopted an intermediate transfer system (a secondary transfer system), developer images carried by an intermediate transfer belt as an image carrier in a primary transfer part are transferred to a medium (a recording medium) in a secondary transfer part. The medium carried to the secondary transfer part is sometimes carried in a state where its shape is curled, and if the medium is carried to the secondary transfer part as it is in the curled state, the curled medium comes into contact with the intermediate transfer belt before the secondary transfer is executed, which induced disturbances in the developer images carried by the intermediate transfer belt in some cases. Then, in order to prevent contact between the medium and the intermediate transfer belt, an image forming apparatus that is provided with a guide part, in a position before the position where the medium enters the secondary transfer part, for appropriately guiding the medium to the secondary transfer part has been proposed (for example, see Patent Document 1).

Patent Document

Japanese Unexamined Patent Application 2011-133529

However, depending on the kind of the medium, there was a problem that when the medium passed through the guide part, the trailing edge of the medium in the carrying direction of the medium jumped up, and by the jumped-up medium contacting with the intermediate transfer belt, contact sound or disturbances in the print image occurred.

Then, an objective of the present application is to prevent the occurrence of the jump-up behavior when the medium passes through the guide part and reduce the occurrence of contact sound during the print operation and disturbances in the print image.

SUMMARY

An image forming apparatus disclosed in the application includes an image carrier that carries a developer image, a carrying part that carries a medium; and a guide part that forms a carrying path to guide the medium carried by the carrying part toward a transfer position where the developer image carried by the image carrier is transferred to the medium. The guide part is configured to change a thickness of the carrying path according to a kind of the medium.

According to the present application, because the occurrence of the jump-up behavior when the trailing edge portion of the medium passes through the guide part can be prevented, the occurrence of contact sound during the print operation and disturbances in images can be reduced.

DETAILED EMBODIMENTS

Embodiment 1

Configuration of the Image Forming Apparatus 100

Figure 1:
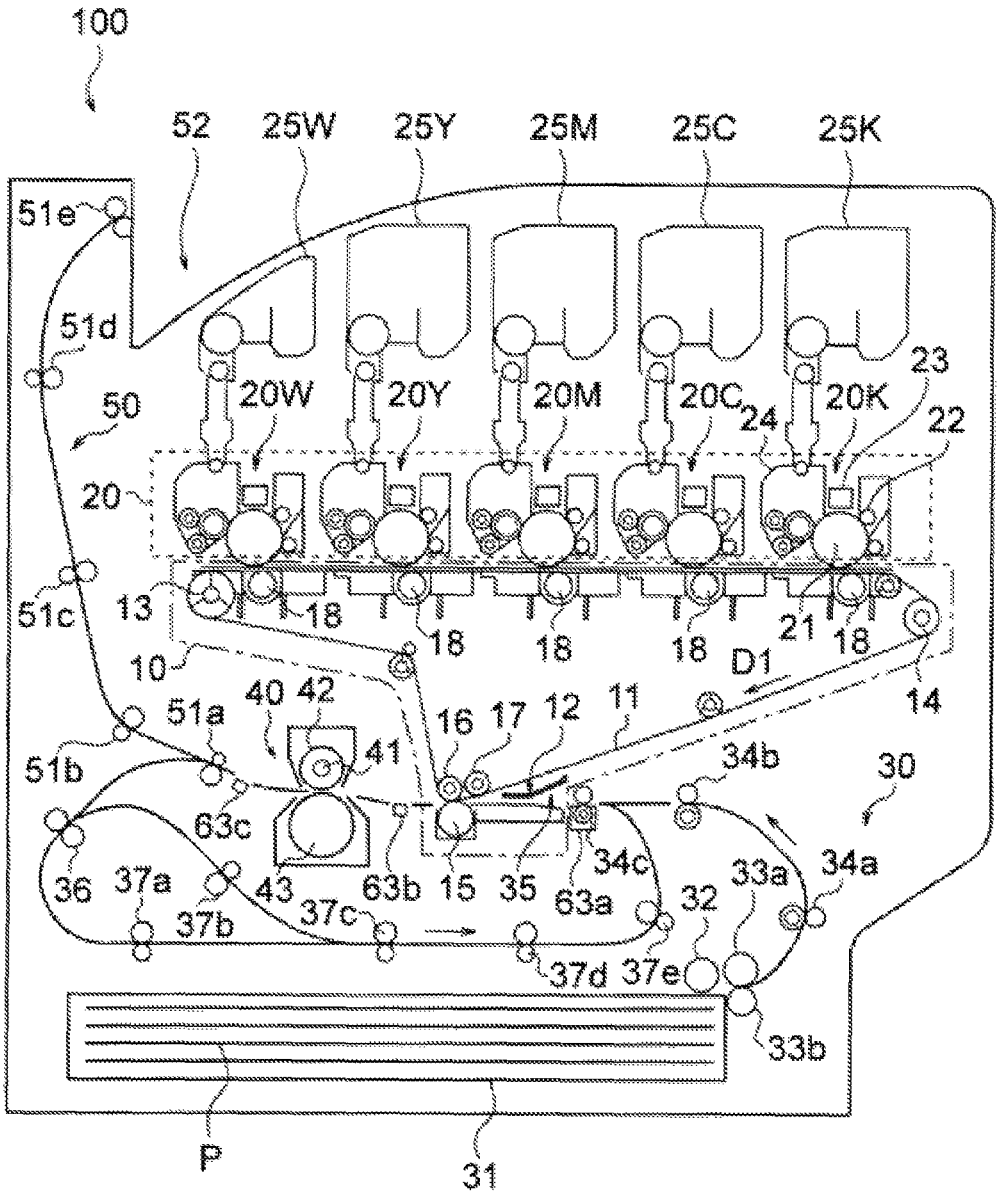
FIG. 1 is a cross-sectional view showing the structure of an image forming apparatus of Embodiment 1 of the present application.
Figure 2:
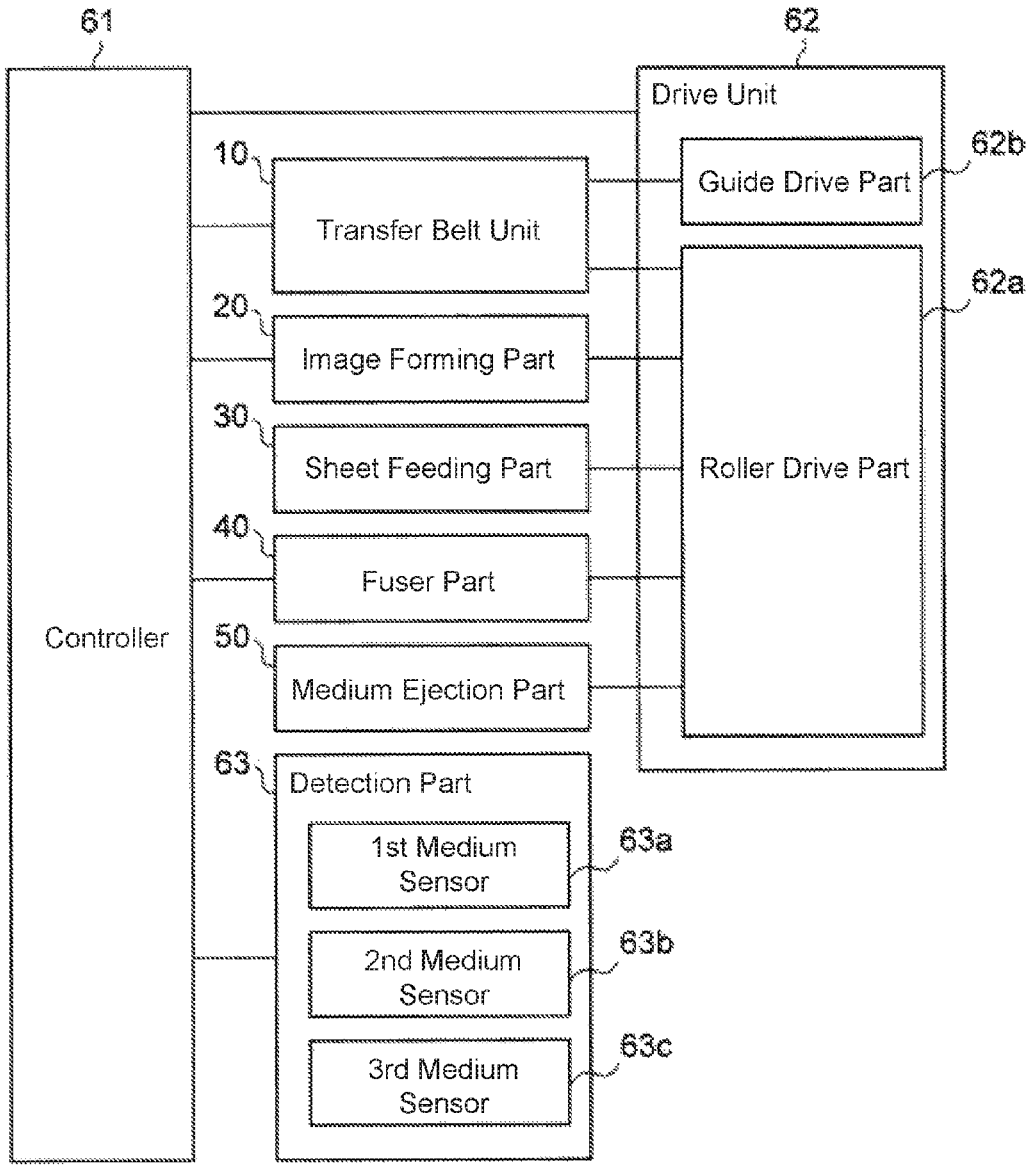
FIG. 2 is a block diagram showing a control system in the image forming apparatus.

FIG. 1 is a cross-sectional view showing the structure of an image forming apparatus 100 of Embodiment 1 of the present application. FIG. 2 is a block diagram showing a control system in the image forming apparatus 100.

The image forming apparatus 100 is provided with a transfer belt unit 10 including an intermediate transfer belt 11 as the image carrier (developer image carrying means) that carries toner images as the developer images.

The image forming apparatus 100 is further provided with an image forming part 20 that forms toner images, a sheet feeding part 30 that feeds and carries a sheet P as the medium (recording medium) toward the image forming part 20, a fuser part 40 that fuses the toner images formed on the sheet P, and a medium ejection part 50 that ejects the sheet P having the toner images fused to the outside of the image forming apparatus 100.

The image forming apparatus 100 is further provided with toner cartridges 25K, 25C, 25M, 25Y, and 25W as developer containing parts that contain toners, a controller 61 that controls individual components inside the image forming apparatus 100, a drive unit 62 that supplies drive forces to drive individual components inside the image forming apparatus 100, and a detection part 63 that detects the sheet P carried inside the image forming apparatus 100.

<Configuration of the Transfer Belt Unit>

The transfer belt unit 10 is provided with the intermediate transfer belt 11 that carries toner images, and a guide part 12 that forms a carrying path 35 to guide the sheet P toward the transfer position (secondary transfer position) where the toner images carried by the intermediate transfer belt 11 are transferred to the sheet P. The "secondary transfer position" denotes the position where the toner images carried by the intermediate transfer belt 11 are transferred to the sheet P, and more specifically, the position between a secondary transfer roller 15 and a backup roller 16 mentioned below.

The transfer belt unit 10 further includes a drive roller 13 that rotationally drives the intermediate transfer belt 11 in the direction of an arrow D1 shown in FIG. 1 (hereafter, also called the "belt carrying direction") through rotating by receiving a drive force from the drive unit 62, a tension roller 14 that rotates driven by the rotational drive of the intermediate transfer belt 11 while stretching the intermediate transfer belt 11, a secondary transfer roller 15 as a transfer member that is disposed in the transfer position (secondary transfer position) and transfers the toner images carried on the surface of the intermediate transfer belt 11 to the sheet P, a backup roller 16 disposed opposing the secondary transfer roller 15 across the intermediate transfer belt 11 sandwiched between them, and a support roller 17 as a stretching member that stretches the intermediate transfer belt 11 in the upstream side of the backup roller 16 in the belt carrying direction.

The transfer belt unit 10 further includes multiple primary transfer rollers 18 as the primary transfer parts disposed opposing the respective photosensitive drums 21 of the below-mentioned image forming units 20K, 20C, 20M, 20Y, and 20W across the intermediate transfer belt 11 sandwiched between them.

The transfer belt unit 10 can be configured detachable from the image forming apparatus 100.

The intermediate transfer belt 11 is, for example, an endless belt. The intermediate transfer belt 11 is configured in such a manner that its surface becomes closer to a below-mentioned second guide member 122 as it moves toward the secondary transfer position.

The secondary transfer roller 15 has a secondary transfer bias applied under the control by the controller 61, and utilizes Coulomb force to secondary-transfer the toner images on the intermediate transfer belt 11 to the sheet P.

The support roller 17 is provided in the upstream side of the secondary transfer roller 15 and the backup roller 16 in the carrying direction of the sheet P, and stretches the intermediate transfer belt 11.

Each of the transfer rollers 18 has the primary transfer bias applied under the control by the controller 61, and utilizes Coulomb force to primary-transfer the toner images formed in the respective image forming units 20K, 20C, 20M, 20Y, and 20W onto the intermediate transfer belt 11.

<Configuration of the Image Forming Part 20>

The image forming part 20 (toner image forming part) includes the image forming units 20K, 20C, 20M, 20Y, and 20W that form toner images using toners of individually different colors. The image forming units 20K, 20C, 20M, 20Y, and 20W are arranged along the belt carrying direction (the moving direction of the intermediate transfer belt 11). For example, the image forming unit 20K uses a black-color toner to form images, the image forming unit 20C uses a cyan-color toner to form images, the image forming unit 20M uses a magenta-color toner to form images, the image forming unit 20Y uses a yellow-color toner to form images, and the image forming unit 20W uses a special-color toner (for example, a clear toner or a white toner) to form images. It is noted that in the image forming apparatus 100, the colors of the toners used or the number of the image forming units are not limited to the examples shown in FIG. 1.

The image forming units 20K, 20C, 20M, 20Y, and 20W are mutually different in their toners (toner colors) used and the same in the structure inside the units.

Each of the image forming units 20K, 20C, 20M, 20Y, and 20W includes the photosensitive drum 21 as the image carrier for carrying the toner image, a charging roller 22 as a charging member that negatively charges the surface of the photosensitive drum 21, a laser head 23 as an exposure member that radiates light onto the surface of the charged photosensitive drum 21 to form an electrostatic latent image, and a development device 24 that supplies a toner to the electrostatic latent image to form a toner image.

The photosensitive drum 21 is, for example, a cylindrical OPC (Organic Photo Conductor) drum.

The laser head 23 includes, for example, LED (Light Emitting Diode) array elements that emit laser light. The development device 24 includes, for example, a development roller for supplying a toner to the photosensitive drum 21, and a supply roller for supplying the toner to the development roller.

The toner cartridges 25K, 25C, 25M, 25Y, and 25W are provided with the black-color toner, the cyan-color toner, the magenta-color toner, the yellow-color toner, and the special-color toner (for example, the clear toner or the white toner), respectively, as toners for replenishment. The toner cartridges 25K, 25C, 25M, 25Y, and 25W are detachable from the image forming apparatus 100.

The image forming units 20K, 20C, 20M, 20Y, and 20W are connected respectively to the toner cartridges 25K, 25C, 25M, 25Y, and 25W where their respective color toners used are stored, and when the toners inside the development devices 24 run short, the toners are supplied from the respective toner cartridges 25K, 25C, 25M, 25Y, and 25W to the development devices 24.

<Configuration of the Sheet Feeding Part 30>

The sheet feeding part 30 includes a medium tray 31 inside which the sheets P are stacked, a pickup roller 32 that forwards the sheets P from the medium tray 31, a feed roller 33*a* and a retard roller 33*b* as a separation roller pair that separates the sheets P forwarded by the pickup roller 32 into single pieces, carrying roller pairs 34*a*, 34*b*, and 34*c* as carrying parts that carry the sheet P toward the secondary transfer position, and a carrying path 35 through which the sheet P passes.

The sheet feeding part 30 further includes a reverse roller pair 36 for double-sided printing, and carrying roller pairs 37*a*, 37*b*, 37*c*, 37*d*, and 37*e* for carrying the sheet P with toner images fused on one side to the secondary transfer position again.

The pickup roller 32 is provided so as to press-contact with the sheet P that has risen to a certain height inside the medium tray 31, and forwards the sheet P through rotating by receiving a drive force from the drive unit 62.

<Configuration of the Fuser Part 40>

The fuser part 40 comprises a heater 41 that becomes a heat source, a fuser roller 42 (upper roller) whose surface is formed of an elastic body, and a backup roller 43 (lower roller) that pressurizes toner images on the sheet P together with the fuser roller 42.

<Configuration of the Medium Ejection Part 50>

The medium ejection part 50 includes ejection roller pairs 51*a*, 51*b*, 51*c*, 51*d*, and 51*e* that carry the sheet P having the toner images fused in the fuser part 40, and a stacker part 52 where the sheets P ejected by the ejection roller pair 51*e* are stacked.

<Configuration of the Control System>

When the print command is received from a host device, the controller 61 controls the drive unit 62 to drive individual components inside the image forming apparatus 100. For example, the controller 61 can send a control signal to a roller drive part 62*a* to rotate the individual rollers inside the image forming apparatus 100 by a drive source (for example, a motor) and a drive mechanism (for example, a gear) included in the roller drive part 62*a*.

Also, when the print command is received from the host device, the controller 61 controls the transfer belt unit 10, the image forming part 20, and the fuser part 40 to execute an image forming process. For example, the controller 61 controls biases applied to the primary transfer rollers 18, the secondary transfer roller 15, the charging rollers 22, and the development devices 24. Also, the controller 61 controls the laser heads 23 to have the laser heads 23 emit laser light that corresponds to the image data included in the print command. Also, the controller 61 controls heating by the heater 41 of the fuser part 40.

The drive unit 62 includes the roller drive part 62*a* as a roller drive means, and a guide drive part 62*b* as a guide drive means. The roller drive part 62*a* includes a drive source such as a motor and a drive mechanism such as a gear, and when a control signal is received from the controller 61, can rotate the photosensitive drums 21 and the individual rollers. The guide drive part 62*b* includes an actuator 71 (for example, a linear actuator) as the drive source, and can supply a drive force for moving a first guide member 121 to the guide part 12.

The detection part 63 includes a first medium sensor 63*a* (paper thickness sensor) as a first medium detection part that detects the kind (for example, the thickness) of sheet P, a second medium sensor 63*b* as a second medium detection part that detects the presence of the sheet P, and a third medium sensor 63*c* as a third medium detection part that detects the presence of the sheet P.

The first medium sensor 63*a* is provided in the vicinity of the carrying roller pair 34*c*, and can detect the thickness (paper thickness) of the sheet P when the sheet P passes through the carrying roller pair 34*c*. It is noted that the first medium sensor 63*a* can be provided in an arbitrary place in the carrying path (including the carrying path 35) that connects the medium tray 31 and the guide part 12. When the sheet P passes through the carrying roller pair 34*c*, other than detecting the thickness (paper thickness) of the sheet P, the first medium sensor 63*a* can also detect the passage of the sheet P through the carrying roller pair 34*c*.

The second medium sensor 63*b* is provided in the downstream side of the secondary transfer roller 15 in the carrying direction of the sheet P, and can detect the passage of the sheet P. For example, by the second medium sensor 63*b* detecting the trailing edge portion of the sheet P in the carrying direction of the sheet P, the passage of the sheet P through the secondary transfer position can be detected.

The third medium sensor 63*c* is provided in the downstream side of the fuser part 40 in the carrying direction of the sheet P, and can detect the passage of the sheet P. For example, by the third medium sensor 63*c* detecting the trailing edge portion of the sheet P in the carrying direction of the sheet P, the passage of the sheet P through the fuser part 40 can be detected.

When the presence of the sheet P is detected, the first medium sensor 63*a*, the second medium sensor 63*b*, and the third medium sensor 63*c* send the detection results to the controller 61. The first medium sensor 63*a* is a sensor that can detect the thickness of the sheet P, and upon detecting the thickness of the sheet P, sends the detection result to the controller 61.

<Configuration of the Guide Part 12>

Figure 3:
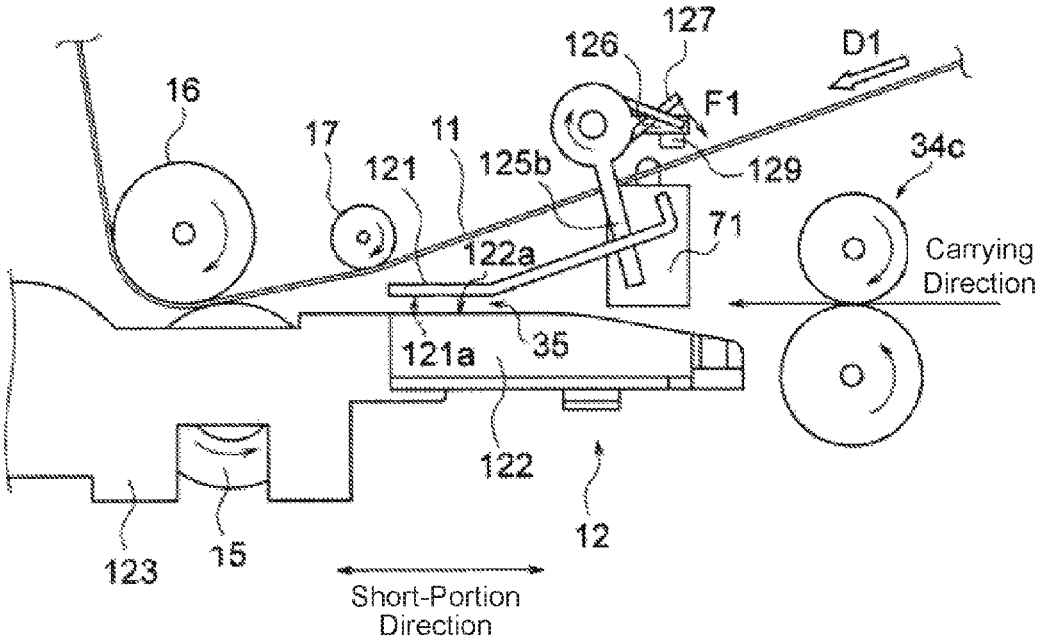
FIG. 3 is a side view showing schematically the internal structure in the vicinity of a secondary transfer position of the image forming apparatus.

FIG. 3 is a side view showing schematically the internal structure of the image forming apparatus 100 in the vicinity of the secondary transfer position. As shown in FIG. 3, in this specification, the "short-portion direction" indicates the direction that is parallel to the carrying direction of the sheet P.

Figure 4:
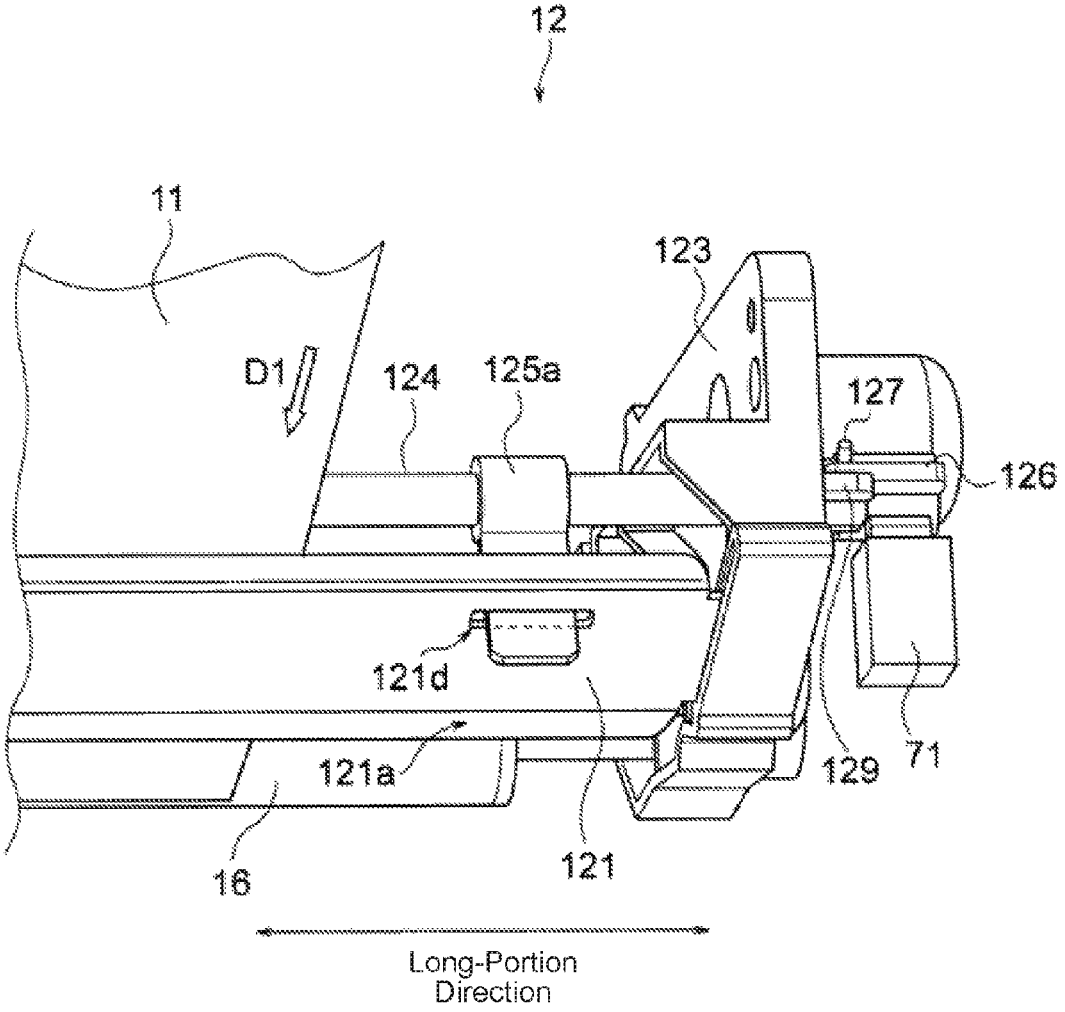
FIG. 4 is a perspective view showing the structure of one-end side in the long-portion direction of a guide part.

FIG. 4 is a perspective view showing the structure of one-end side in the long-portion direction of the guide part 12. As shown in FIG. 4, in this specification, the "long-portion direction" is the direction that is perpendicular to the short-portion direction and parallel to the rotation axis of a drive shaft 124. The guide part 12 shown in FIG. 4 is the structure viewed from the upstream side in the carrying direction of the sheet P, and shows the structure of only one-end side in the long-portion direction. The guide part 12 can be given the same structure for the other-end side that is not shown in FIG. 4. It is noted that the other-end side of the guide part 12 can be given a structure that is not provided with the actuator 71, a second lever 126, or a spring 127 mentioned below.

Figure 5A:
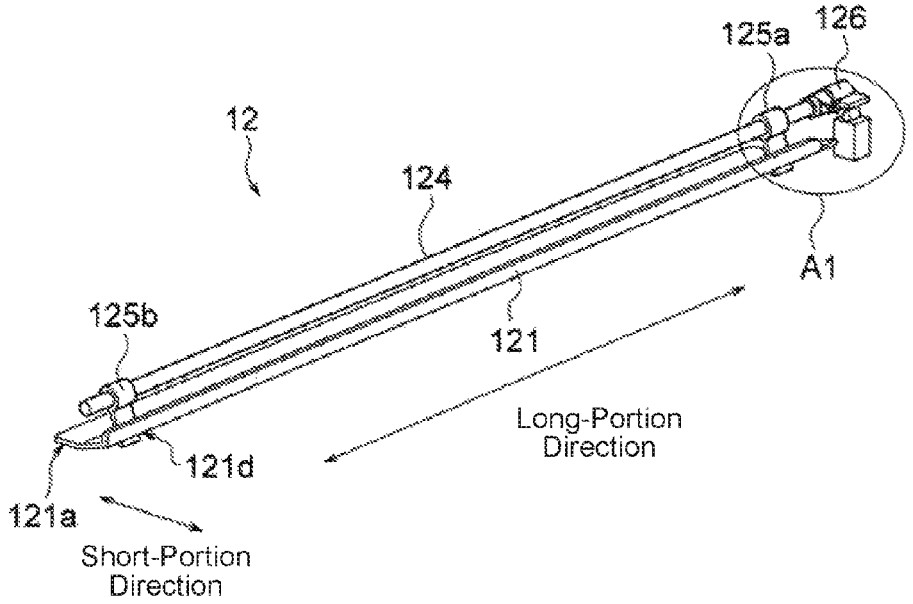
FIG. 5A is a perspective view showing the whole structure excluding a supporting member inside the guide part.
Figure 5B:
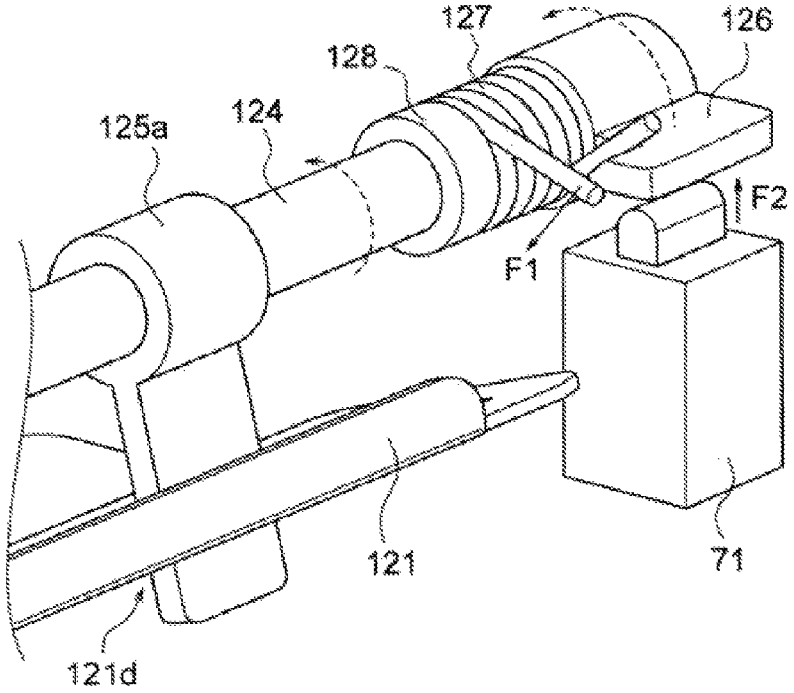
FIG. 5B is an enlarged perspective view showing the structure of one-end side (region A1) of the guide part shown in FIG. 5A.

FIG. 5A is a perspective view showing the whole structure excluding the supporting member 123 inside the guide part 12, and FIG. 5B is an enlarged perspective view showing the structure of one-end side (region A1) of the guide part 12 shown in FIG. 5A.

The guide part 12 is configured in such a manner that the thickness of the carrying path 35 formed by the first guide member 121 changes according to the kind (for example, the thickness) of the sheet P. Specifically, the guide part 12 is configured in such a manner that the thickness of the carrying path 35 is changed by the first guide member 121 moving according to the thickness of the sheet P. The "thickness of the carrying path 35 formed by the first guide member 121" (hereafter called the "thickness of the carrying path 35") is the distance between the first guide face 121*a* forming the wall face on the side of the carrying path 35 of the first guide member 121 and the second guide face 122*a* forming the wall face on the side of the carrying path 35 of the second guide member 122.

An example of the specific configuration of the guide part 12 is explained. As shown in FIG. 3, the guide part 12 includes the first guide member 121 that forms one wall face in the thickness direction of the carrying path 35, the second guide member 122 that opposes the wall face (first guide face 121*a*) of the carrying path 35 formed by the first guide member 121 and forms the other wall face (second guide face 122*a*) in the thickness direction of the carrying path 35, and the supporting member 123 that movably supports the first guide member 121.

As shown in FIGS. 3, 4, 5A, and 5B, the guide part 12 further includes the drive shaft 124 that is rotatably supported by the supporting member 123, the first levers 125*a* and 125*b* that are supported by the drive shaft 124 and move the first guide member 121, the second lever 126 that is supported at an end of the drive shaft 124 and rotates the drive shaft 124 and the first levers 125*a* and 125*b* by receiving a drive force from the actuator 71, the spring 127 that is provided at an end of the drive shaft 124 and biases the first guide member 121 toward the normal guide position through the drive shaft 124 and the first levers 125*a* and 125*b*, a bearing 128 that is provided inside the supporting member 123 and rotatably holds the drive shaft 124, and a stopper part 129 that restricts the amount of movement (amount of rotation) of the second lever 126.

The "normal guide position" denotes the position where the first guide member 121 rests in a state before starting a movement as shown in FIG. 3. In other words, the "normal guide position" denotes the position were the first guide member 121 rests because the rotation of the second lever 126 is restricted by the stopper part 129. Usually, when plain paper is used as the sheet P, the guide part 12 guides the sheet P to the secondary transfer position in a state where the first guide member 121 rests in the normal guide position.

In this specification, the "plain paper" denotes a sheet whose basis weight (g/m$^2$) is less than 200 g/m$^2$, such as Excellent White A4 (basis weight 80 g/m$^2$) manufactured by Oki Data Corporation. In the image forming apparatus 100 of Embodiment 1, the sheet P of about 100 g/m$^2$ in basis weight is usually used as the plain paper.

As shown in FIG. 5B, the drive shaft 124 is rotatably held by the bearing 128.

Figure 6:
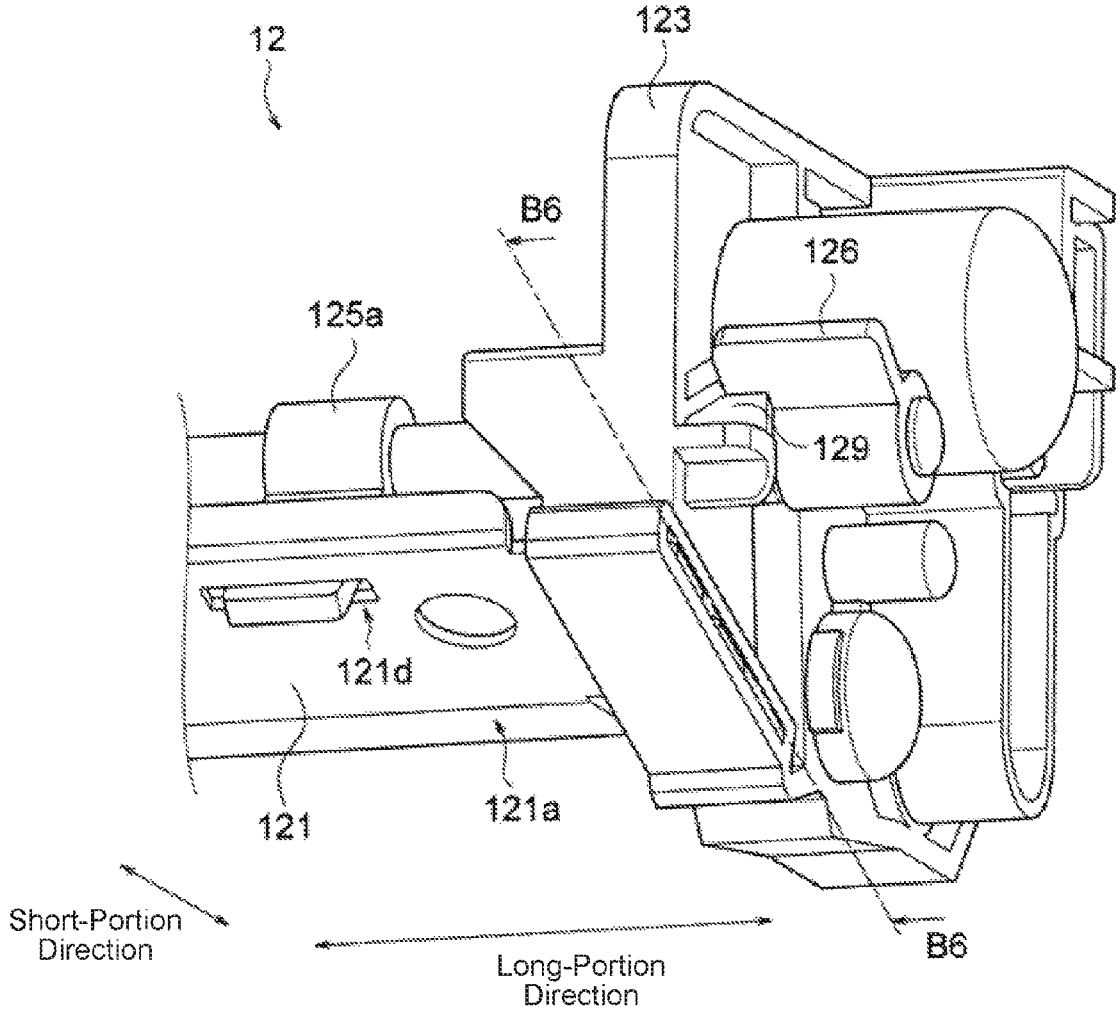
FIG. 6 is a perspective view showing the structure of one-end side in the long-portion direction of the guide part.

FIG. 6 is a perspective view showing the structure of one-end side in the long-portion direction of the guide part 12. The guide part 12 shown in FIG. 6 is the structure viewed from the upstream side in the carrying direction of the sheet P, and shows the structure of only one-end side in the long-portion direction.

Figure 7:
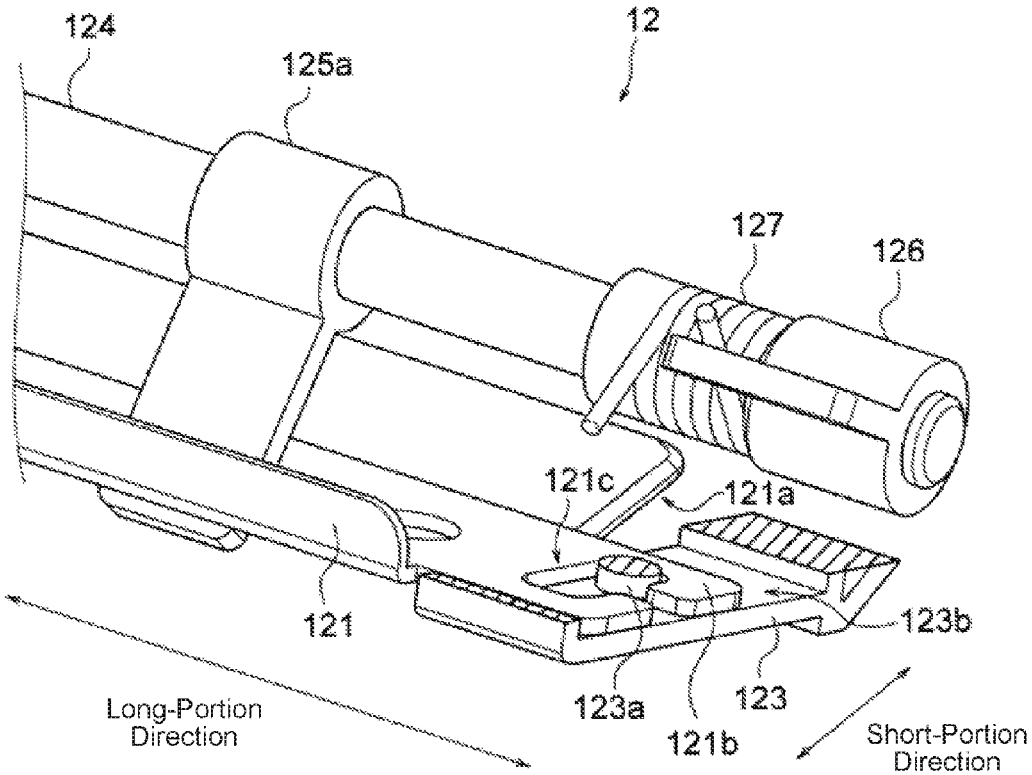
FIG. 7 is a perspective view showing the structure of the guide part, including the cross-sectional structure when the supporting member shown in FIG. 6 is cut along a line B6-B6.

FIG. 7 is a perspective view showing the structure of the guide part 12, including the cross-sectional structure when the supporting member 123 is cut along a line B6-B6 shown in FIG. 6. Shaded areas shown in FIG. 7 indicate the cross section when the supporting member 123 is cut along the line B6-B6.

Figure 8A:
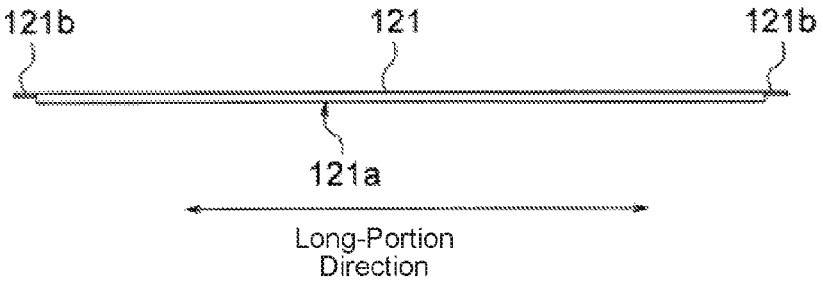
FIG. 8A is a front view of a first guide member.
Figure 8B:
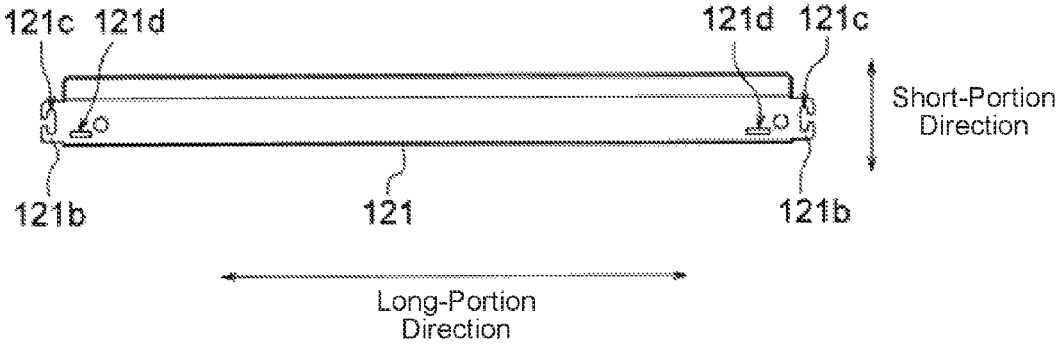
FIG. 8B is a plan view of the first guide member.

FIG. 8A is a front view of the first guide member 121, and FIG. 8B is a plan view of the first guide part 121.

As shown in FIGS. 6, 7, and 8, the first guide member 121 includes the first guide face 121*a* forming the wall face of the carrying path 35 over the long-portion direction of the first guide member 121, slide parts 121*b* provided on both-end sides in the long-portion direction of the first guide member 121, long holes 121*c* provided on both-end sides in the long-portion direction of the first guide member 121, and multiple fitting parts 121*d* in a square hole shape provided on both-end sides in the long-portion direction of the first guide member 121. The long holes 121*c* have a long shape in a direction perpendicular to the long-portion direction.

The first guide face 121*a* forms the carrying path 35 by forming the wall face of the first guide member 121 opposing the second guide member 122 (specifically, the second guide face 122*a*). Also, the first guide face 121*a* guides the sheet P carried up by the carrying roller pair 34*c* to the secondary transfer position without having it contact with the intermediate transfer belt 11.

The second guide member 122 forms the carrying path 35 by forming the wall face of the second guide member 122 opposing the first guide member 121 (specifically, the first guide face 121*a*). Also, the second guide face 122*a* guides the sheet P carried up by the carrying roller pair 34*c* to the secondary transfer position.

The first guide face 121*a* and the second guide face 122*a* form the carrying path 35, through which the sheet P passes.

As shown in FIG. 7, the supporting member 123 includes a restriction part 123*a* that engages with one of the long holes 121*c* of the first guide member 121, and a slide face 123*b* that supports the first guide member 121 movably in parallel to a portion of the surface of the intermediate transfer belt 11 opposing the second guide member 122.

The first guide member 121 has the slide parts 121*b* provided on both-end sides in the long-portion direction supported by the supporting member 123 slidably on the slide face 123*b* of the supporting member 123.

The restriction part 123*a* restricts the amount of movement of the first guide member 121. Specifically, if the first guide member 121 slides by a specified distance in a direction perpendicular to the long-portion direction, by the inner wall of one of the long holes 121*c* contacting with the restriction part 123*a*, the movement of the first guide member 121 is restricted.

The first levers 125*a* and 125*b* are each provided on both sides in the long-portion direction of the drive shaft 124 so as to sandwich the sheet P. That is, the first levers 125*a* and 125*b* are each provided on both sides in the long-portion direction of the drive shaft 124 with a wider interval than the maximum width of the sheet P. The first levers 125*a* and 125*b* are rotatable in their state provided to the drive shaft 124. Specifically, because an end of each of the first levers 125*a* and 125*b* is fixed to the drive shaft 124, by the drive shaft 124 rotating, the first levers 125*a* and 125*b* can rotate together with the drive shaft 124.

Because the tip parts of the first levers 125*a* and 125*b* are respectively fitted with the fitting parts 121*d* provided on both sides in the long-portion direction of the first guide member 121, by rotating the first levers 125*a* and 125*b*, the first guide member 121 can be moved (let slide).

The second lever 126 is rotatable in its state provided to the drive shaft 124. Specifically, because the second lever 126 is fixed to the drive shaft 124, by receiving a drive force from the actuator 71, it can rotate together with the drive shaft 124. By the second lever 126 rotating together with the drive shaft 124 by receiving the drive force from the actuator 71, the first levers 125*a* and 125*b* rotate together with the drive shaft 124, and the first guide member 121 slides from the normal guide position.

The spring 127 constantly gives a bias force F1 (that is, a torque to the drive shaft 124) to the first guide member through the drive shaft 124 and the first levers 125*a* and 125*b* in the direction to return the first guide member 121 to the normal guide position. By making a drive force F2 of the actuator 71 greater than the bias force F1 by the spring 127, the first guide member 121 can be let slide.

If driving the actuator 71 is stopped, the second lever 126 loses the drive force F2 received from the actuator 71. Because the spring 127 constantly biases the first guide member 121 toward the normal guide position through the drive shaft 124 and the first levers 125*a* and 125*b*, if driving the actuator 71 is stopped, the first guide member 121 returns to the normal guide position. The stopper part 129 is provided in a position in contact with the second lever 126 in such a manner that the first guide member 121 rests in the normal guide position. That is, when driving the actuator 71 is stopped, by the bias force F1 of the spring 127 the second lever 126 rotates by a specified amount together with the drive shaft 124, the second lever 126 comes into contact with the stopper part 129, and the rotations of the second lever 126 and the drive shaft 124 stop.

The actuator 71 is not limited to the configuration that it is provided outside the transfer belt unit 10. For example, it may be configured in such a manner that the actuator 71 is provided inside the transfer belt unit 10.

Figure 9:
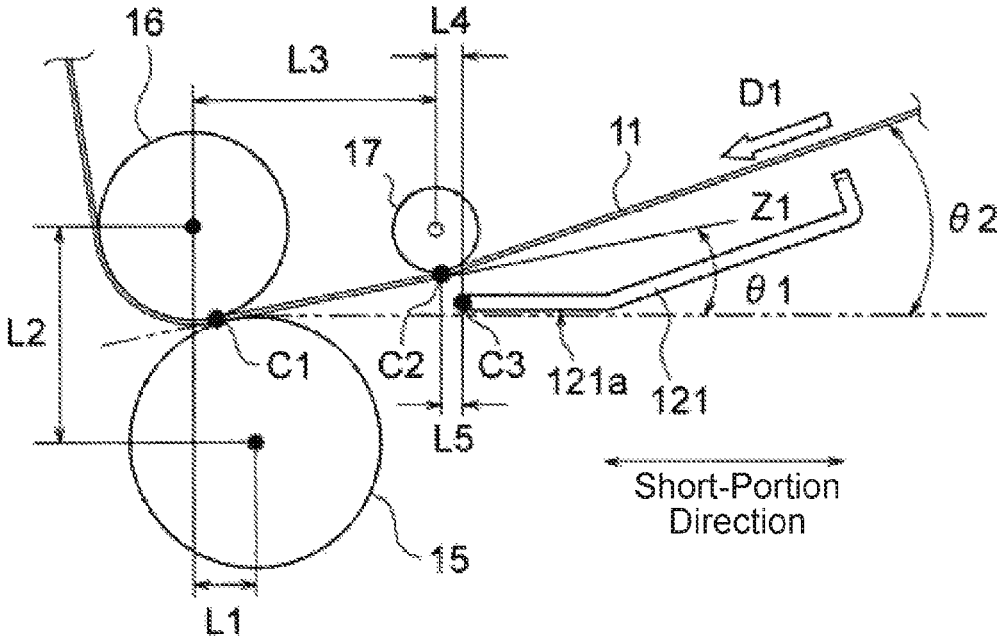
FIG. 9 is a cross-sectional view showing schematically the internal structure in the vicinity of the secondary transfer position the image forming apparatus.

FIG. 9 is a cross-sectional view showing schematically the internal structure of the image forming apparatus 100 in the vicinity of the secondary transfer position. The distance L1 in the short-portion direction between the rotation axis of the secondary transfer roller 15 and the rotation axis of the backup roller 16 is, for example, 5.9 mm. The distance L2 in a direction perpendicular to the short-portion direction between the rotation axis of the secondary transfer roller 15 and the rotation axis of the backup roller 16 is, for example, 19.8 mm. The distance L3 in the short-portion direction between the rotation axis of the backup roller 16 and the rotation axis of the support roller 17 is, for example, 22.9 mm. The distance L4 in the short-portion direction between the rotation axis of the support roller 17 and a tip C3 of the first guide member 121 is, for example, 2.5 mm. The distance L5 in the short-portion direction between the contact point C2 between the support roller 17 and the intermediate transfer belt 11 and a tip C3 of the first guide member 121 is, for example, 2.7 mm.

A first angle $\theta_1$ that is an angle formed by a line Z1 passing through the contact point C1 between the secondary transfer roller 15 and the backup roller 16 and the contact point C2 between the support roller 17 and the intermediate transfer belt 11 and the first guide face 121*a* is, for example, 11.1°. A second angle $\theta_2$ that is an angle formed by the surface of the intermediate transfer belt 11 in the upstream side of the support roller 17 in the belt carrying direction within the intermediate transfer belt 11 and the first guide face 121*a* is, for example, 18.9°.

The distances L1-L5 and angles $\theta_1$ and $\theta_2$ vary depending on a type of medium. Especially, the distance L1 largely contributes the transfer performance (degree of developer transferring) of the apparatus. The angle $\theta_1$ is equal to or above zero, largely contributing the transfer performance as well. Smaller angle $\theta_1$ realizes larger transfer performance. Since preferred ranges of the distance L1 and angle $\theta_1$, they are determined in consideration of each other.

The diameter of the secondary transfer roller 15 is, for example, 24 mm. The diameter of the backup roller 16 is, for example, 18 mm. The diameter of the support roller 17 is, for example, 8 mm.

<Basic Operation of the Image Forming Apparatus 100>

Figure 10A:
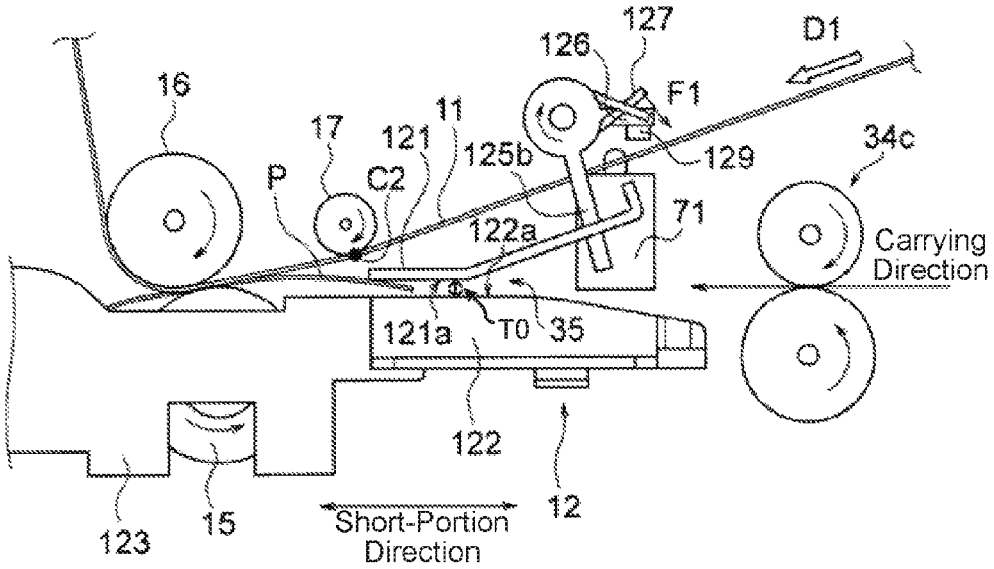
FIGS. 10A to 10C are side views showing the state of the guide part before and after the movement of the first guide member.
Figure 10B:
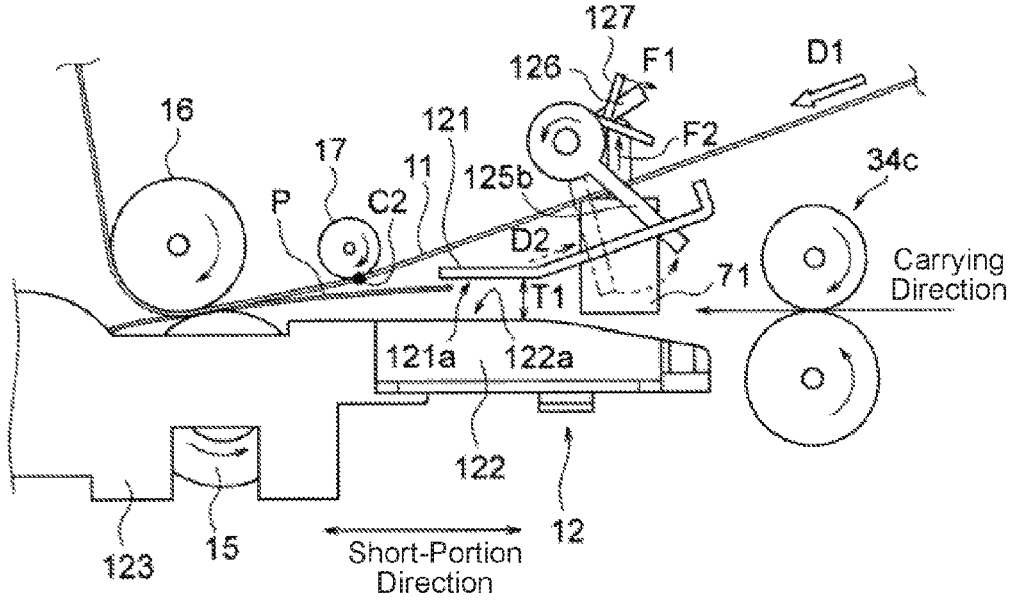

Next, the basic operation of the image forming apparatus 100 is explained. FIGS. 10A and 10B are side views showing the state of the guide part 12 before and after the movement of the first guide member 121. The guide part 12 shown in FIG. 10A is in a state where the first guide member 121 rests in the normal guide position. The guide part 12 shown in FIG. 10B is in a state where the movement of the first guide member 121 is complete, driven by the actuator 71.

When the print command (including image data) is input to the controller 61 of the image forming apparatus 100 from the host device such as an external computer, the controller 61 sends a control signal based on the print command to the roller drive part 62*a*, and the photosensitive drum 21 in each of the image forming units 20K, 20C, 20M, 20Y, and 20W and the drive roller 13 rotate to start an image formation in each of the image forming units 20K, 20C, 20M, 20Y, and 20W. Besides, although the image forming units used differ sometimes depending on the image data, because the operations are mutually the same in the image forming units 20K, 20C, 20M, 20Y, and 20W, as for the operations in the image forming units, the operation of one of the image forming units is explained as an example below.

When image data based on the print command are sent to the controller 61, the controller 61 sends a control signal corresponding to the image data to the laser head 23.

To the charging roller 22 a specified charging bias applied, and the surface of the photosensitive drum 21 is uniformly charged by the charging roller 22.

The laser head 23 irradiates the uniformly-charged surface of the photosensitive drum 21 with light corresponding to the image data to form an electrostatic latent image.

The development device 24 supplies a developer onto the surface of the photosensitive drum 21, where the electrostatic latent image is formed, to form a toner image based on the electrostatic latent image.

Individual toner images formed in the image forming units 20K, 20C, 20M, 20Y, and 20W are sequentially transferred so as to be superimposed on the surface of the intermediate transfer belt 11 by the primary transfer rollers 18 provided opposing the respective image forming units.

The image formation is started in each of the image forming units 20K, 20C, 20M, 20Y, and 20W, after a specified period of time has passed, the roller drive part 62*a* rotates the pickup roller 32, the pickup roller 32 forwards the sheets P, the sheets P are separated into single pieces by the feed roller 33*a* and the retard roller 33*b*, and the sheet P is carried by the carrying roller pairs 34*a* and 34*b* toward the secondary transfer position.

In the vicinity of the carrying roller pair 34*c*, the first medium sensor 63*a* is provided. When the leading edge portion of the sheet P in the carrying direction of the sheet P has passed through the first medium sensor 63*a*, the first medium sensor 63*a* detects the passage of the leading edge portion of the sheet P. Upon detecting the passage of the leading edge portion of the sheet P, the first medium sensor 63*a* sends the detection result to the controller 61.

Also, the first medium sensor 63*a* detects the thickness of the sheet P when the sheet P passes through the first medium sensor 63*a*. Upon detecting the thickness of the sheet P, the first medium sensor 63*a* sends the detection result to the controller 61.

The controller 61 judges whether the thickness of the sheet P exceeds a specified threshold value or not. As the threshold value, for example, the basis weight (g/m$^2$) of the sheet P can be used, such as 200 g/m$^2$. If the detection result of the thickness of the sheet P by the first medium sensor 63*a* does not exceed the specified threshold value, the controller 61 judges that the sheet P is a medium (for example, plain paper) that does not require the first guide member 121 to be moved, and does not move the first guide member 121 as shown in FIG. 10A. It is noted that the threshold value is not limited to the case of 200 g/m$^2$ in basis weight but may be set to another value.

As shown in FIG. 10A, the sheet P passes through the carrying path 35 and is carried to the secondary transfer position by the carrying roller pair 34*c*. If the sheet P is plain paper, in order to have the sheet P appropriately enter the secondary transfer position, the thickness of the carrying path 35 should desirably be small. If the sheet P is plain paper and the first guide member 121 is not moved, the thickness of the carrying path 35 is, for example, 2 mm.

In the example shown in FIG. 10A, although the sheet P passes through the first guide member 121 guided by the first guide member 121 while the trailing edge portion of the sheet P is contacting with the first guide member 121, no jump-up behavior of the trailing edge portion of the sheet P occurs.

To the secondary transfer roller 15 a transfer voltage is applied, and when the sheet P reaches the secondary transfer position, the toner images carried on the surface of the intermediate transfer belt 11 are transferred to the sheet P. Once the toner images are transferred to the sheet P in the secondary transfer position, the sheet P reaches the fuser part 40.

When the sheet P, to which the toner images transferred, is carried to the fuser part 40 and passes between the fuser roller 42 and the backup roller 43, heat and pressure are applied to the sheet P to fuse the toner images on the sheet P.

The sheet P, to which the toner images are fused, is ejected by the ejection roller pairs 51*a*, 51*b*, 51*c*, 51*d*, and 51*e* to the outside of the image forming apparatus 100.

<Operation of the Guide Part 12>

Next, the operation of the guide part 12 (the operation when the first guide member 21 is moved) is explained based on FIG. 10B.

In the print operation of the image forming apparatus 100, when the sheet P passes through the first medium sensor 63*a*, the thickness of the sheet P is detected. If the detection result of the thickness of the sheet P by the first medium sensor 63*a* exceeds a specified threshold value, the controller 61 judges that the sheet P is special paper (for example, thick paper) as a medium that requires the first guide member 121 to be moved, sends a control signal for moving the first guide member 121 to the drive unit 62 (specifically, the guide drive part 62*b*) to control the drive unit 62 (specifically, the guide drive part 62*b*).

As the threshold value, for example, the basis weight ($g/m^2$) of the sheet P can be used, such as 200 $g/m^2$. Note that the threshold value is not limited to 200 $g/m^2$ in basis weight but may be set to another value.

In this specification, "thick paper" denotes a sheet of 200 $g/m^2$ or more in basis weight ($g/m^2$). In this specification, "special paper" also includes, other than thick paper, media that are less than 200 $g/m^2$ in basis weight and have high rigidity, and media that are less than 200 $g/m^2$ in basis weight and have a large elastic force. Examples of "special paper" are film media, label media, envelopes, postcards, embossed paper, and the like.

For example, paper having longitudinal rigidity less than 4500 $N/mm^2$ may be regarded as the special paper. In a case where the media that are less than 200 $g/m^2$, the media are determined as the special paper in the basis of print result, for example, a status or condition of the trailing edge. The operator may input manually a temperature for fusing, a type of medium etc via an input device. Alternatively, the determination may be made by using various sensors, such as an optical sensors to detect the status or condition of the trailing edge of media.

Upon receiving a control signal from the controller 61 for moving the first guide member 121, the guide drive part 62*b* drives the actuator 71 as shown in FIG. 10B to rotate the second lever 126 by the drive force F2 in the linear direction, which rotates the drive shaft 124.

Because the first levers 125*a* and 125*b* are respectively fitted with the fitting parts 121*d* provided on both sides in the long-portion direction of the first guide member 121, by the first levers 125*a* and 125*b* rotating together with the drive shaft 124, the first guide member 121 slides in parallel with the surface of the intermediate transfer belt 11 (in the direction of an arrow D2 shown in FIG. 10B) while being supported by the slide face 123*b*. When the first guide member 121 slides, the amounts of movement (linear distances) of the tip parts of the first levers 125*a* and 125*b* fitted with the fitting parts 121*d* are, for example, 9 mm, respectively.

Figure 10C:
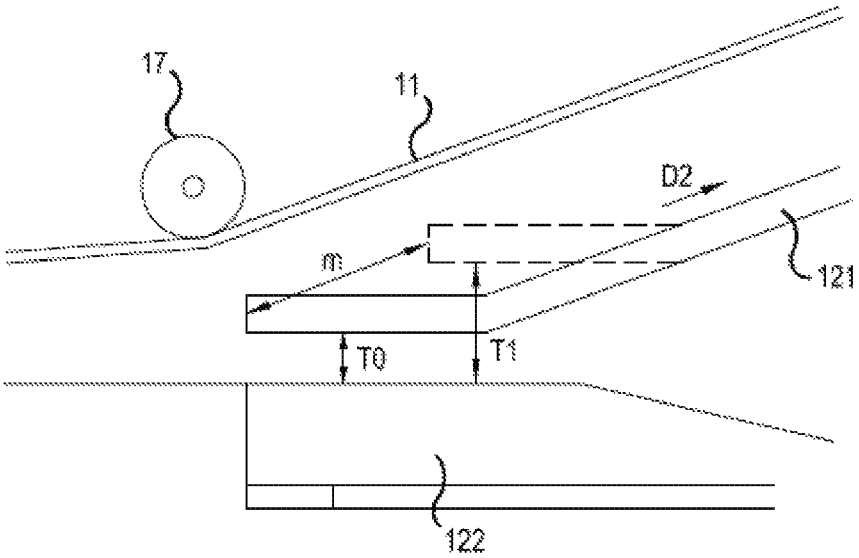

As shown in FIG. 10B, when the first guide member 121 slides, the first guide member 121 moves in such a manner that the thickness T1 of the carrying path 35 becomes larger than the distance between the contact point C2 between the support roller 17 and the intermediate transfer belt 11 and the surface of the second guide member 122 (second guide face 122*a*), and moves to the position where the trailing edge portion in the carrying direction of the sheet P does not contact with the first guide member 121. The leading edge oriented toward the carrying direction of the first guide member 121 should desirably move to a higher position than the lower end of the support roller 17, and the thickness T1 of the carrying path 35 is, for example, 5 mm. The thickness T1 is preferably larger than the thickness of the sheet P by 0.5 mm or more. In addition, to increase the thickness of the carrying path 35 to T1, the first guide member 12 needs to be moved in the direction parallel with the surface of the intermediate transfer belt 11 (in the direction of an arrow D2 shown in FIG. 10C) by an amount of movement m. The amount of movement m can be determined from the following equation:

$$m=(T1-T0)/\sin\theta 2$$

where T0 is the normal thickness of the carrying path 35 (i.e., a distance between the first guide member 121 and the second guide member 122 at the time when the first guide member 121 is at the normal guide position) (see FIG. 10A).

The timing of moving the first guide member 121 can be arbitrarily set. It is noted that when the first guide member 121 slides, the first guide member 121 should desirably separate from the sheet P after the leading edge portion of the sheet P in the carrying direction of the sheet P passed through the tip part of the first guide member 121 oriented toward the carrying direction and before the trailing edge portion of the sheet P in the carrying direction passes through the tip part of the first guide member 121.

Also, it may be configured in such a manner that when the detection result by the first medium sensor 63*a* has exceeded the specified threshold value (that is, when the controller 61 has judged that the first guide member 121 is required to be moved), the controller 61 controls the drive unit 62 (specifically, the guide drive part 62*b*) to move the first guide member 121 at the timing when the second medium sensor 63*b* has detected the presence of the sheet P.

Also, it may be configured in such a manner that when the detection result by the first medium sensor 63*a* has exceeded the specified threshold value, the first guide member 121 is moved after a specified period of time has passed since the time when the first medium sensor 63*a* detected the thickness of the sheet P. The specified period may be defined as a timing before the trailing edge of the sheet P, which is assigned to be printed, in the longitudinal direction reaches an upstream side (or sheet feeding side) of the guide member 2.

Also, it may be configured in such a manner that when the detection result by the first medium sensor 63*a* has exceeded the specified threshold value, the first guide member 121 is moved at the timing when the leading edge portion of the sheet P has reached between the secondary transfer roller 15 and the backup roller 16.

At the timing when the trailing edge of the sheet P has passed through the secondary transfer roller 15, driving the actuator 71 is stopped, the drive force received by the second lever 126 from the actuator 71 is released, and the first guide member 121 returns to the normal guide position and rests by the bias force F1 of the spring 127.

Besides, by the second medium sensor 63*b* or the third medium sensor 63*c* detecting the passage of the trailing edge of the sheet P, the controller 61 can judge that the sheet P has passed through the secondary transfer position. By the third medium sensor 63*c* detecting the passage of the trailing edge of the sheet P, the controller 61 can judge that the sheet P has passed through the fuser part 40.

Although in the example explained above, a case where the sheet P requiring the first guide member 121 to be moved was thick paper was explained as an example, the image forming apparatus 100 explained in Embodiment 1 can also be applied to other special paper, for example, media that are less than 200 g/m$^2$ in basis weight (g/m$^2$) and have high rigidity. In this case, for example, by presetting the print mode of the image forming apparatus 100 to a print mode where the first guide member 121 is moved at a specified timing, even when printing onto a medium of high rigidity, the occurrence of the jump-up behavior of the training edge of the sheet P can be prevented regardless of the thickness of the sheet P.

According to Embodiment 1, by configuring the guide member 12 in such a manner that the first guide member 121 moves according to the kind (for example, the thickness) of the sheet P to change the thickness of the carrying path 35, the occurrence of the jump-up behavior when the trailing edge portion of the sheet P passes through the first guide member 121 can be prevented, thereby the occurrence of contact sound during the print operation and disturbances in the print image can be reduced.

When the first guide member 121 slides, by the first guide member 121 separating from the sheet P after the leading edge portion of the sheet P in the carrying direction of the sheet P (thick paper) passed through the tip part of the first guide member 121 oriented toward the carrying direction and before the trailing edge portion of the sheet P in the carrying direction passes through the tip part of the first guide member 121, even if the sheet P is carried up to the secondary transfer position in a curled state, the leading edge portion of the sheet P can be guided to the secondary transfer position by the first guide member 121 without contacting with the surface of the intermediate transfer belt 11, thereby the occurrence of the jump-up behavior of the trailing edge of the sheet P can be prevented.

When the first guide member 121 slides, by moving the first guide member 121 in such a manner that the thickness of the carrying path 35 becomes larger than the distance between the contact point C2 between the support roller 17 and the intermediate transfer belt 11 and the surface of the second guide member 122 (the second guide face 122*a*), the occurrence of the jump-up behavior of the trailing edge of the sheet P can be prevented even more efficiently.

By having the support roller 17 contact with the intermediate transfer belt 11 in the upstream side of the second transfer roller 15 in the carrying direction of the sheet P to stretch the intermediate transfer belt 11, the second angle $\theta_2$ can be made greater than the first angle $\theta_1$, thereby a space for moving the first guide member 121 in parallel with the surface of the intermediate transfer belt 11 can be formed.

Also, by adopting a configuration that the first guide member 121 of the guide part 12 is moved, there is no need to move the secondary transfer roller 15.

Embodiment 2

Figure 11:
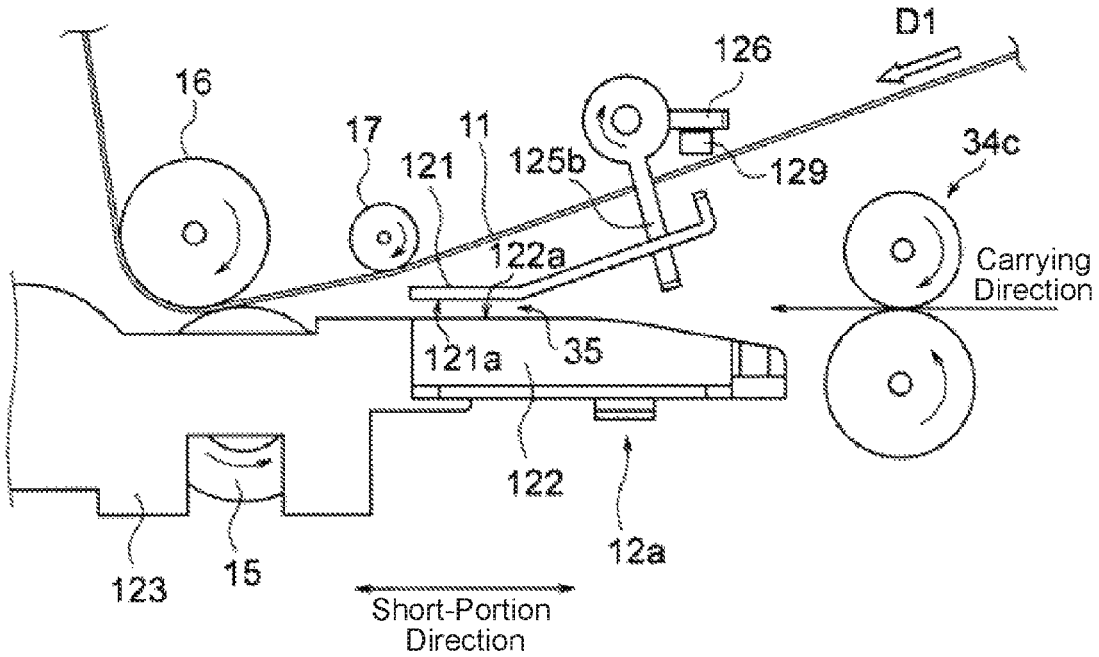
FIG. 11 is a side view showing schematically the internal structure in the vicinity of the secondary transfer position of the image forming apparatus of Embodiment 2 of the present application.

FIG. 11 is a side view showing schematically the internal structure of the image forming apparatus of Embodiment 2 of the present application in the vicinity of the secondary transfer position.

The image forming apparatus of Embodiment 2 is different from the image forming apparatus 100 of Embodiment 1 in that the actuator 71 and the spring 127 explained in Embodiment 1 are not provided, and is the same as the image forming apparatus 100 of Embodiment 1 in other respects. Therefore, for the components in the image forming apparatus of Embodiment 2, those components that are identical or correspond to the components in the image forming apparatus 100 of Embodiment 1 will be explained using the same codes as the components in the image forming apparatus 100 of Embodiment 1.

The guide part 12*a* shown in FIG. 11 is in a state before the first guide member 121 moves, that is, a state where the first guide member 121 rests in the normal guide position. Specifically, although the first guide member 121 tries to move (slide) to narrow the thickness of the carrying path 35 by its own weight, by the second lever 126 contacting with the stopper part 129, the first guide member 121 rests in the normal guide position. Under the condition using a plain sheet having an A4 width (210 mm, cc200), the resilience force by the sheet is approximately 0.43 kgf.

Figure 12A:
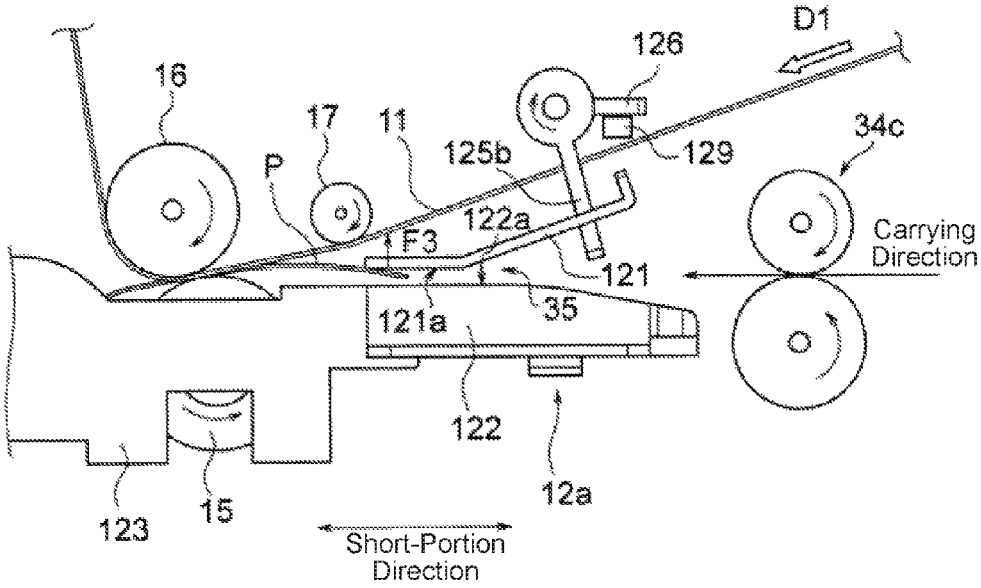
FIGS. 12A and 12B are side views showing the state of the guide part before and during the movement of the first guide member included in the image forming apparatus of Embodiment 2.
Figure 12B:
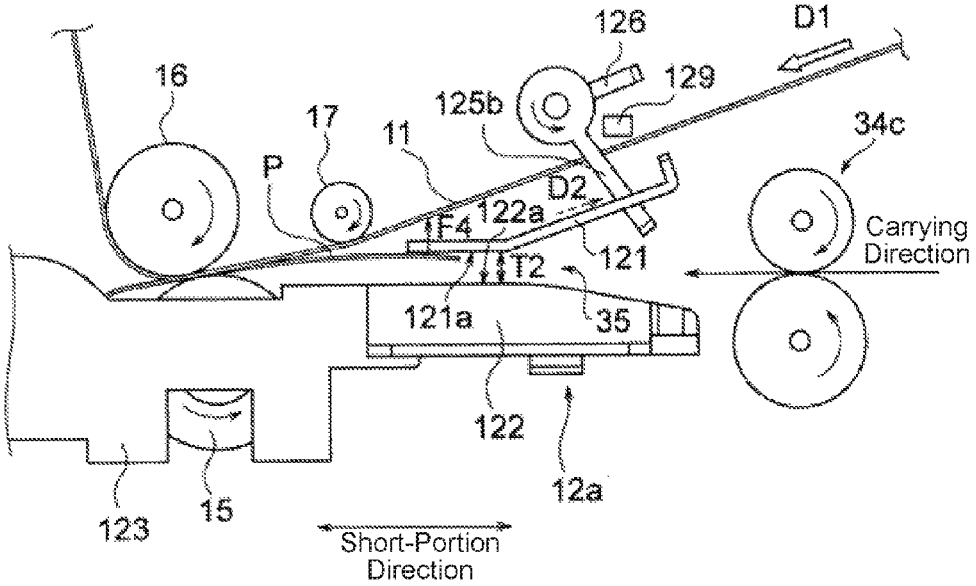

FIGS. 12A and 12B are side views showing the states of the guide part 12*a* before and during the movement of the first guide member 121 included in the image forming apparatus of Embodiment 2, respectively. FIG. 12A shows the state of the guide part 12*a* when plain paper is used as the sheet P, and FIG. 12B shows the state of the guide part 12*a* when special paper is used as the sheet P.

The guide part 12*a* shown in FIG. 12A is in a state where the first guide member 121 rests in the normal guide position. As shown in FIG. 12A, in the print operation of the image forming apparatus, the sheet P carried up by the carrying roller pair 34*c* enters between the first guide member 121 and the second guide member 122.

When the sheet P is plain paper, because a force F3 given to the first guide member 121 by the sheet P is weak, the first guide member 121 guides the sheet P to the secondary transfer position without moving (sliding).

Also, when the sheet P is plain paper, even if the trailing edge portion of the sheet P in the carrying direction of the sheet P passes through the carrying path 35 while contacting with the first guide member 121, the jump-up behavior of the trailing edge of the sheet P does not occur. It is noted that when the sheet P is plain paper, the sheet P may sometimes enter the secondary transfer position without any contact between the sheet P and the first guide member 121.

On the other hand, as shown in FIG. 12B, when the sheet P is special paper and a force F4 given to the first guide member 121 by the elasticity of the sheet P is greater than the force by the own weight of the first guide member 121, by receiving the force F4 given by the sheet P, the first guide member 121 slides in the a direction parallel to the surface of the intermediate transfer belt 11 (the direction of an arrow D2 shown in FIG. 12B) by the amount of movement m while being supported by the slide face 123*b*. That is, the drive force that moves the first guide member 121 is given by the sheet P that passes while contacting with the first guide member 121.

The first guide member 121 of the guide part 12*a* slides as shown in FIG. 12B without detecting the kind (for example, the thickness) of the sheet P by the first medium sensor 63*a* when the force F4 given to the first guide member 121 by the elasticity of the sheet P is greater than the force by the own weight of the first guide member 121.

In the embodiment, the force F3 (linear pressure) by the plain paper is preferably less than 20 N/m. For force F4, it is preferred to use a medium that generates a linear pressure of 20 N/m or more.

As shown in FIG. 12B, when the sheet P is special paper, the sheet P passes through the first guide member 121 while the trailing edge portion of the sheet P moves the first guide member 121. Therefore, by the first guide member 121 sliding while receiving the force F4 given by the sheet P, the guide part 12*a* changes the thickness of the carrying path 35 and absorbs the force F4 given by the sheet P. By the first guide member 121 gradually absorbing the force F4 of the sheet P while sliding, even if the trailing edge portion of the sheet P is in contact with the first guide member 121 (specifically, the first guide face 121*a*) when the trailing edge portion of the sheet P passes through the first guide member 121, the jump-up behavior of the trailing edge of the sheet P can be eased.

When the sheet P is special paper, the thickness T2 of the carrying path 35 when the trailing edge portion of the sheet P has passed through the first guide member 121 while moving the first guide member 121 should preferably be 5 mm or less. It is noted that it may be configured in such a manner that the thickness T2 of the carrying path 35 becomes an appropriate thickness according to the thickness, elastic force, etc. of the sheet P.

In the image forming apparatus of Embodiment 2, the occurrence of the jump-up behavior of the trailing edge of the sheet P can be prevented without using the first medium sensor for performing the judgment whether to move the first guide member 121 of the guide part 12*a*, or the second medium sensor 63*b* and the third medium sensor 63*c* for determining the timing to move the first guide member 121. It is noted that for grasping the position of the sheet P inside the image forming apparatus, the first medium sensor 63*a*, the second medium sensor 63*b*, or the third medium sensor 63*c* may be used.

According to Embodiment 2, the occurrence of the jump-up behavior when the trailing edge portion of the sheet P passes through the first guide member 121 can be prevented by configuring the guide part 12*a* in such a manner that the thickness of the carrying part 35 is changed by the first guide member 121 moving according to the kind of the sheet P (for example, thick paper, a medium having a large elastic force, a medium with high rigidity, etc.), thereby the occurrence of contact sound during the print operation and disturbances in images can be reduced.

Also, according to Embodiment 2, because the drive force that moves the first guide member 121 is given by the sheet P that passes while contacting with the first guide member 121, the first guide member 121 can be moved according to the kind of the sheet P without using a drive part for moving the first guide member 121.

Although configurations provided with the guide parts 12 and 12*a* in the transfer belt unit 10 were explained as examples in the embodiments explained above, the configurations of the guide parts 12 and 12*a* are not limited to the configuration that they are provided to the transfer belt unit 10. For example, the guide parts 12 and 12*a* may be configured in such a manner that they are fixed to the inner wall of the chassis of the image forming apparatus.

The configurations explained in the embodiments explained above can also be applied to multifunction printers, facsimile machines, multifunction machines, or photocopiers.

What is claimed is:

1. An image forming apparatus, comprising:

an intermediate transfer belt that carries a developer image;

a carrying part that carries a medium; and a guide part that forms a carrying path to guide the medium carried by the carrying part toward a transfer position where the developer image carried by the intermediate transfer belt is transferred to the medium, wherein the guide part includes a first guide member that forms a first guide surface of the carrying path, a second guide member that is opposed from the first guide surface, forms a second guide surface of the carrying path, the first guide member moves along the intermediate transfer belt, in a direction reverse to a belt carrying direction of a part of the intermediate transfer belt opposed from the second guide member.

2. The image forming apparatus according to claim 1, wherein the guide part includes a supporting member that movably supports the first guide member.

3. The image forming apparatus according to claim 2, wherein the intermediate transfer belt is configured in such a manner that an image carrying surface of the intermediate transfer belt approaches closer to the second guide member as the intermediate transfer belt moves toward the transfer position, and the supporting member includes a slide surface that supports the first guide member movably in a direction parallel to a portion of the surface of the image carrier facing the second guide member.

4. The image forming apparatus according to claim 1, wherein the first guide member includes a tip part of the first guide member oriented toward a downstream of the carrying direction, and the first guide member separates from the medium after a leading edge portion of the medium in a carrying direction of the medium passed through the tip part of the first guide member but before a trailing edge portion of the medium in the carrying direction passes through the tip part of the first guide member.

5. The image forming apparatus according to claim 1, further comprising:

a drive unit that supplies a drive force that causes the first guide member to move.

6. The image forming apparatus according to claim 1, further comprising:

a transfer member that transfers the developer images carried on an image carrying surface of the intermediate transfer belt to the medium at the transfer position.

7. The image forming apparatus according to claim 6, further comprising:

a stretching member that movably stretches the intermediate transfer belt and that is arranged on an upstream side of the transfer member in the carrying direction of the medium.

8. The image forming apparatus according to claim 7, wherein the guide part is configured in such a manner that after the first guide member moves, a distance between the first guide surface and the second guide surface becomes larger than a distance between a contact point of the stretching member and the intermediate transfer belt and the second guide surface.

9. The image forming apparatus according to claim 5, further comprising:

a first medium detection part that detects the thickness of the medium, and a controller that controls the drive unit to move the first guide member when a detection result by the first medium detection part exceeds a predetermined threshold value.

10. The image forming apparatus according to claim 5, further comprising:

a first medium detection part that detects the thickness of the medium, a second medium detection part that detects presence of the medium, and a controller that controls the drive unit to move the first guide member at a timing when the second medium detection part detects presence of the medium when the detection result by the first medium detection part has exceeded a predetermined threshold value.

11. The image forming apparatus according to claim 1, wherein the drive force to move the first guide member is applied by the medium that passes while contacting with the first guide member.

12. The image forming apparatus according to claim 7, wherein the first guide member includes a tip part of the first guide member oriented toward a downstream of the carrying direction, and the guide part configured in such a manner that after the first guide member moves, a distance between the tip part of the first guide member and the second guide surface becomes larger than a distance between a contact point between the stretching member and the intermediate transfer belt and the second guide surface.

13. The image forming apparatus according to claim 5, wherein the first guide member includes a tip part of the first guide member oriented toward a downstream of the carrying direction;

the image forming apparatus further comprising:

a controller that controls the drive unit to move the first guide member after a leading edge portion of the medium in a carrying direction of the medium passed through the tip part of the first guide member but before a trailing edge portion of the medium in the carrying direction passes through the tip part of the first guide member.

14. The image forming apparatus according to claim 13, further comprising:

a medium detection part that is arranged on a downstream side of the transfer position and that detects passage of the medium;

wherein the controller controls the drive unit to move the first guide member after the medium detection part detects the passage of the medium.

15. The image forming apparatus according to claim 13, further comprising:

a medium detection part that is arranged on an upstream side of the transfer position and that detects passage of the medium;

wherein the controller controls the drive unit to move the first guide member after a period of time has passed from when the medium detection part detects the passage of the medium.

16. The image forming apparatus according to claim 13, further comprising:

a first medium detection part that is arranged on a upstream side of the transfer position and that detects the thickness of the medium, and a second medium detection part that is arranged on a downstream side of the transfer position and that detects presence of the medium;

wherein the controller controls the drive unit to move the first guide member at a timing when the second medium detection part detects presence of the medium when the detection result by the first medium detection part has exceeded a predetermined threshold value.

* * * * *